US012584378B2

(12) United States Patent
Roycroft et al.

(10) Patent No.: US 12,584,378 B2
(45) Date of Patent: Mar. 24, 2026

(54) DART AND CLUTCH ASSEMBLY

(71) Applicant: Epic Lift Systems, Houston, TX (US)

(72) Inventors: Robert G. Roycroft, Houston, TX (US); Shannon Freeman, Tomball, TX (US)

(73) Assignee: EPIC LIFT SYSTEMS, Houston, TX (US)

( * ) Notice: Subject to any disclaimer, the term of this patent is extended or adjusted under 35 U.S.C. 154(b) by 0 days.

(21) Appl. No.: 18/164,492

(22) Filed: Feb. 3, 2023

(65) Prior Publication Data

US 2023/0175353 A1 Jun. 8, 2023

Related U.S. Application Data

(63) Continuation-in-part of application No. 17/751,032, filed on May 23, 2022.

(60) Provisional application No. 63/309,364, filed on Feb. 11, 2022, provisional application No. 63/278,423, filed on Nov. 11, 2021, provisional application No. 63/225,237, filed on Jul. 23, 2021.

(51) Int. Cl.

| | |
|---|---|
| ***E21B 34/14*** | (2006.01) |
| ***E21B 34/06*** | (2006.01) |
| ***E21B 43/12*** | (2006.01) |
| ***F04B 47/12*** | (2006.01) |
| ***F04B 53/12*** | (2006.01) |

(52) U.S. Cl.

CPC ..... *E21B 34/142* (2020.05); *E21B 43/127* (2013.01); *E21B 34/06* (2013.01); *F04B 47/12* (2013.01); *F04B 53/129* (2013.01)

(58) Field of Classification Search

CPC ..... E21B 43/121; E21B 34/06; F04B 47/12; F04B 53/129

See application file for complete search history.

(56) References Cited

U.S. PATENT DOCUMENTS

| | | | |
|---|---|---|---|
| 1,588,705 | A | 6/1926 | Cope et al. |
| 3,801,235 | A | 4/1974 | Douglas |
| 4,239,458 | A | 12/1980 | Yeatts |
| 4,531,891 | A | 7/1985 | Coles, III |
| 6,045,335 | A | 4/2000 | Dinning |

(Continued)

FOREIGN PATENT DOCUMENTS

| | | |
|---|---|---|
| CA | 2598685 C | 9/2014 |

OTHER PUBLICATIONS

PCS Ferguson, "PCS Ferguson Spiral Bar Stock Liquid Aeration Plunger (LAP)" Youtube video located at https://www.youtube.com/watch?v=ZVkvsJaw0Q8, transcript of video downloaded Feb. 8, 2023.

(Continued)

*Primary Examiner* — David N Brandt

(74) *Attorney, Agent, or Firm* — Michael Dowler; Park, Vaughan, Fleming & Dowler LLP

(57) ABSTRACT

Described herein are embodiments of systems and apparatuses that include a dart and/or a clutch for a dart plunger. In an exemplary embodiment, the dart plunger includes a dart adapted to move between a first position and a second position and also between a maximum closed position and a minimum closed position. Varying diameters of the dart enable the clutch to variably retard movement of the dart between its first, second, maximum, and minimum positions.

60 Claims, 18 Drawing Sheets

(56) References Cited

U.S. PATENT DOCUMENTS

| | | | | |
|---|---|---|---|---|
| 6,644,399 | B2 | 11/2003 | Abbott et al. | |
| 7,290,602 | B2 | 11/2007 | Victor | |
| 7,314,080 | B2 | 1/2008 | Giacomino | |
| D596,500 | S | 7/2009 | Diss et al. | |
| 8,347,954 | B2 | 1/2013 | Amies et al. | |
| 8,485,263 | B2 | 7/2013 | Lembcke | |
| 9,869,165 | B2 | 1/2018 | Hightower et al. | |
| 9,915,133 | B2 | 3/2018 | Boyd et al. | |
| 10,273,789 | B2 | 4/2019 | Boyd et al. | |
| 2010/0044055 | A1 | 2/2010 | Pena | |
| 2014/0116714 | A1 | 5/2014 | Jefferies et al. | |
| 2016/0010436 | A1 | 1/2016 | Boyd | |
| 2016/0215600 | A1 | 7/2016 | Roycroft et al. | |
| 2016/0238002 | A1 | 8/2016 | Williams et al. | |
| 2016/0245417 | A1* | 8/2016 | Boyd | F04B 47/12 |
| 2017/0058652 | A1 | 3/2017 | Boyd et al. | |
| 2017/0107802 | A1* | 4/2017 | Kuykendall | E21B 43/121 |
| 2018/0155998 | A1 | 6/2018 | Davies et al. | |
| 2021/0079911 | A1 | 3/2021 | Boyd et al. | |
| 2022/0145736 | A1* | 5/2022 | Boyd | H04L 67/1095 |
| 2024/0068326 | A1* | 2/2024 | Boyd | E21B 34/06 |

OTHER PUBLICATIONS

Screen captures and transcript from YouTube video clip entitled "PCS Ferguson Spiral Bar Stock Liquid Aeration Plunger (LAP)" uploaded on Oct. 1, 2015 by user "PCSFerguson" Retrieved from Internet: <https://www.youtube.com/watch?v=ZVkvsJaw0Q8>.

* cited by examiner

DART AND CLUTCH ASSEMBLY

PRIORITY CLAIM

This application is a continuation in part of application Ser. No. 17/751,032 filed on May 23, 2022, which claims priority to provisional patent application Ser. No. 63/225,237 filed Jul. 23, 2021, and further to provisional patent application Ser. No. 63/278,423 filed Nov. 11, 2021, and further to provisional patent application Ser. No. 63/309,364 filed Feb. 11, 2022, each of which is fully incorporated herein by reference.

TECHNICAL FIELD OF THE INVENTION

Embodiments of the subject matter disclosed herein relate to an improved dart and clutch and assembly, and methods of operating and using the same.

DISCUSSION OF THE BACKGROUND

It is well known that production from oil and gas wells can suffer due to the build-up of fluids at the bottom of the well. Various methods and devices have been developed to remove those fluids so as to improve the well's productivity. The present invention assists in that process.

SUMMARY

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is later discussed.

Described herein are embodiments of systems and apparatuses that include a dart plunger wherein movement of the dart is at least partially controlled by a clutch. In an embodiment, of which there are others, including still others that will be appreciated by those skilled in the art having read the present specification and drawings, the dart has a shaft whose diameter varies from end to end, namely the shaft may have a smaller diameter toward its opposite ends and a larger diameter between its opposite ends, and the clutch may include a one-piece device as described in more detail below in the detailed description of the invention.

BRIEF DESCRIPTION OF THE DRAWINGS

The disclosure may be understood by reference to the following description taken in conjunction with the accompanying drawings, in which like reference numerals identify like elements, and in which.

DETAILED DESCRIPTION

Various features and advantageous details are explained more fully with reference to the non-limiting embodiments that are illustrated in the accompanying drawings and detailed in the following description. Descriptions of well-known starting materials, processing techniques, components, and equipment are omitted so as not to unnecessarily obscure the invention. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended or implied. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 1:
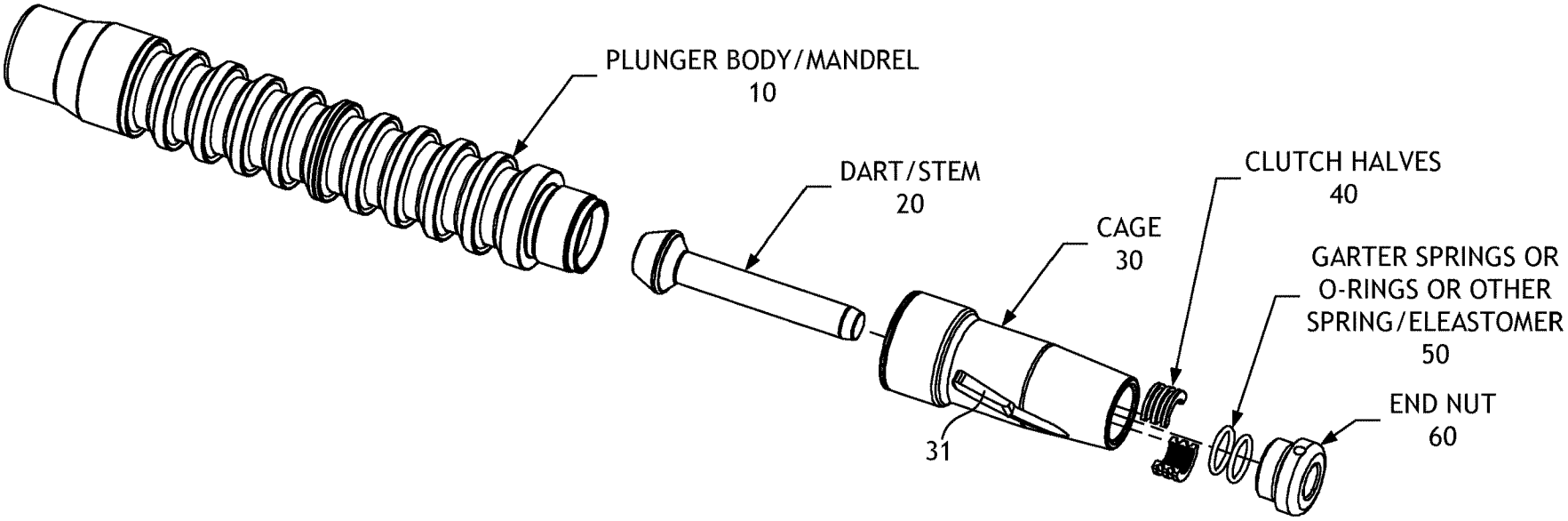
FIG. 1 (PRIOR ART)
FIG. 1 is an assembly view of one embodiment of a prior art dart plunger.

The present embodiments describe an improved dart and clutch assembly. FIG. 1 is an assembly view of one embodiment of a prior art dart plunger. Those skilled in the art will appreciate the purpose, function, and operation of a dart plunger.

Essentially, a dart plunger is a device for removing liquids from a well. The plunger is released into the top of a well, were it then travels/falls down the well. When it strikes the bottom (or a stopper) of the well, the plunger's dart is forced into its "closed" position, such that fluid and gases are substantially prohibited from passing through the interior of the plunger. When the pressure below the plunger is sufficiently greater than the pressure above the plunger, the plunger begins to rise (or travel up) toward the top of the well. This upward travel, in combination with the fact that gases and liquids cannot travel through the interior of the plunger, causes the plunger to push such liquids toward the top of the well, where they are eventually removed from the well.

When the plunger reaches the top of the well, a rod typically in the wellhead's lubricator forces the plunger's dart back into its "open" position, where liquids and gases are allowed to flow through the interior of the plunger. (The plunger includes a clutch that tends to keep the dart in its open or closed position, as the case may be.) This causes the plunger to once again fall down the well, where the process/cycle is repeated. In this fashion, liquids can be removed from the well, thereby enabling the well to flow more freely, to the economic benefit of its producer.

As indicated, FIG. 1 is an assembly view of one embodiment of a prior art dart plunger. As shown, it includes a plunger body or mandrel 10, a dart or stem 20, a cage 30, a clutch 40 (in this case formed from two halves), a tensioning member 50 (such as garter springs, o-rings, or some other spring/elastomer), and an end nut 60. These are conventional components, as a person skilled in the art will appreciate. As can be seen and as those skilled in the art already will appreciate, dart 20 will substantially block flow through plunger body 10 when it is in its "closed" position, and will it will allow flow through plunger body 10 when it is in its "open" position. Clutch halves 40 (in combination with tensioning member(s) 50) keep dart 20 from freely moving between its open and closed position. Specifically, clutch halves 40 tend to keep dart 20 in either its open or closed position unless a push rod in the wellhead's lubricator (or some other device) forces dart 20 from its closed to its open position, or the plunger (with the dart extending through the bottom of the plunger in its open position) strikes the bottom of the well (or some other stopper device), thereby forcing dart 20 from its open to its closed position. End nut 60 keeps dart 20 and clutch 40 inside cage 30.

Figure 2:
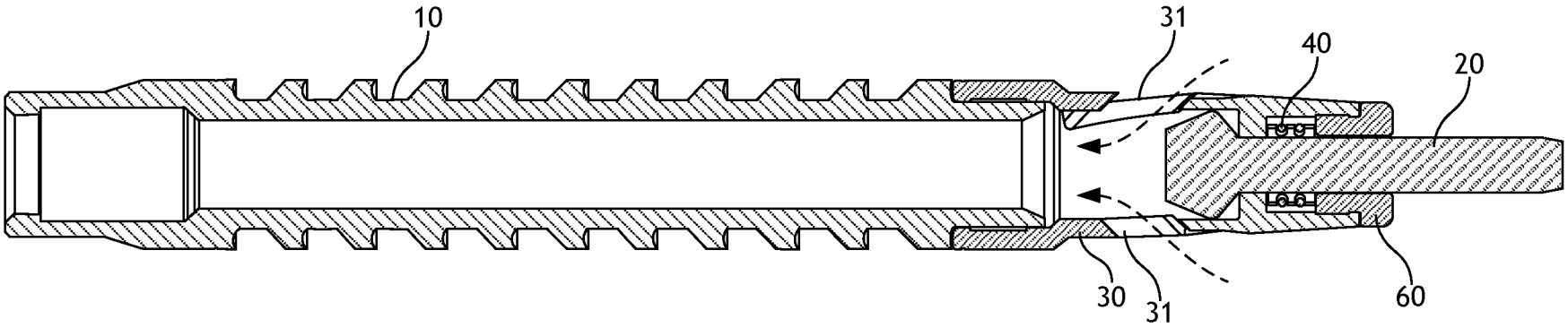
FIG. 2 is a cross-sectional view of an assembled view of FIG. 1.

FIG. 2 is a cross-sectional view of an assembled view of FIG. 1. In particular, FIG. 2 shows the dart plunger in its open position, such that fluids and gases from the well can travel through opening(s) 31 in cage 30 and then up through the hollow interior of plunger body 10, as shown by the dashed arrows in FIG. 2. FIG. 2 also more clearly depicts the operation of clutch 40 on dart 20, whereby clutch 40 exerts a frictional force on dart 20 so as to generally maintain dart 20 in either its open (as shown in FIG. 2) or its closed position.

Figure 3:
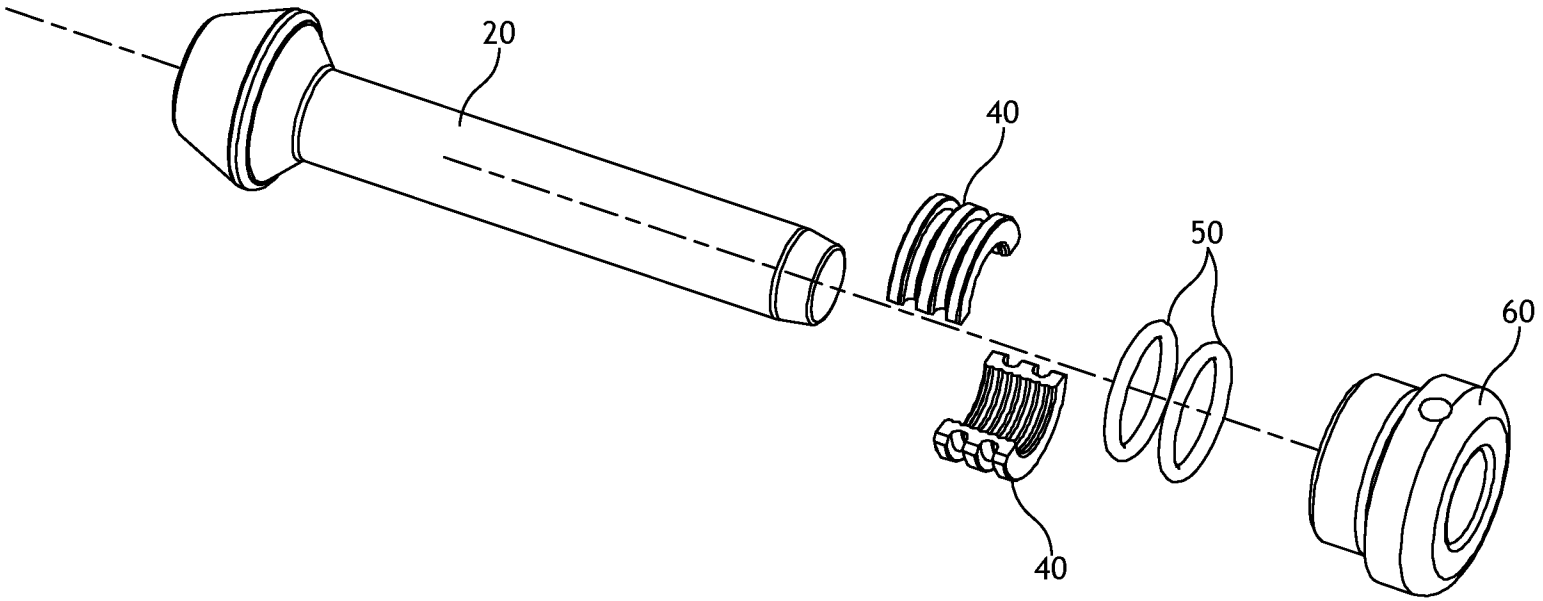
FIG. 3 is a partial assembly view of the dart plunger assembly shown in FIG. 1.

FIG. 3 is a partial assembly view of the dart plunger assembly shown in FIG. 1, more specifically showing the relationship between dart 20, clutch 40, tensioning members 50, and end nut 60. Specifically, in this particular embodiment, clutch 40 includes two halves, which are positioned around the stem of dart 20 so as to create the frictional force explained above to help maintain dart 20 in a stationary position. Notably, prior art clutches 40 consist of more than one piece, typically two, but also can include more than two pieces. Likewise, tensioning member 50 can consist of one or more separate members, the elasticity of which can be selected to assist in adjusting the friction between clutch 40 and dart 20. End nut 60 includes an interior passage sized to allow a portion of the stem of dart 20 to extend therethrough, thereby providing a surface against which dart 20 can strike the bottom of the well and force dart 20 from its open position to its closed position against the frictional force otherwise exerted by clutch 40 on dart 20.

Figure 4B:
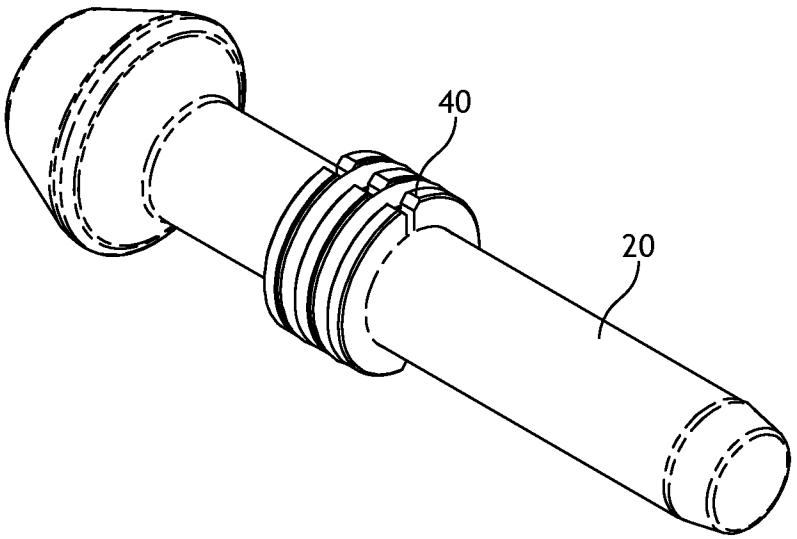
FIG. 4B is a perspective view of the dart and clutch assembly shown in FIG. 1.
Figure 4A:
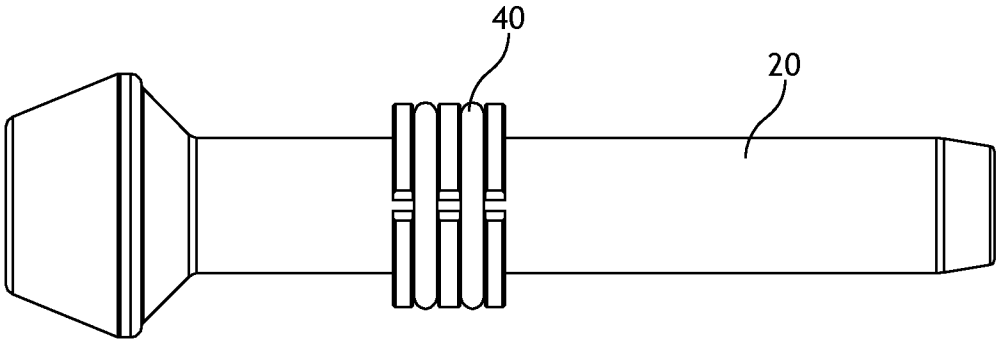
FIG. 4A is a side view of the dart and clutch assembly shown in FIG. 1.

FIG. 4A is a side view of the dart and clutch assembly shown in FIG. 1, and FIG. 4B is a perspective view of the dart and clutch assembly shown in FIG. 1. As explained above, the arrangement of dart 20 and clutch 40 enables dart 20 to slide between its open and closed position so long as the force causing the sliding operation is greater than the frictional force exerted on dart 20 by clutch 40. Such frictional force can be adjusted by a variety of means known to those skilled in the art, including adjusting the size and fit of clutch 40.

Figure 5B:
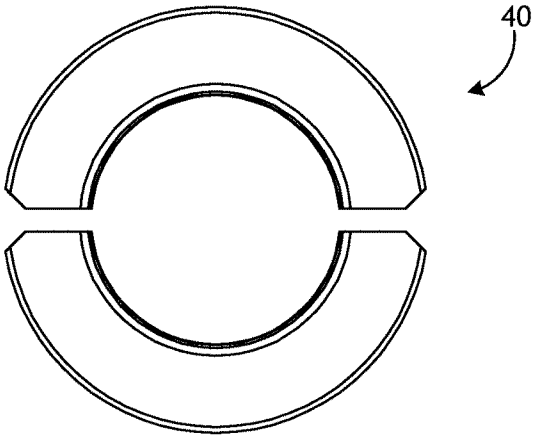
FIG. 5B is a top view of the clutch assembly shown in FIG. 1.
Figure 5C:
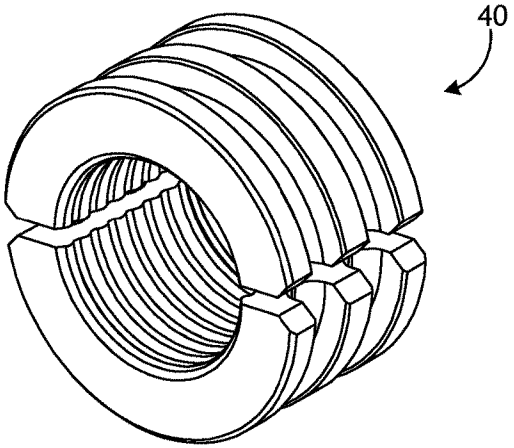
FIG. 5C is a perspective view of the clutch assembly shown in FIG. 1.
Figure 5A:
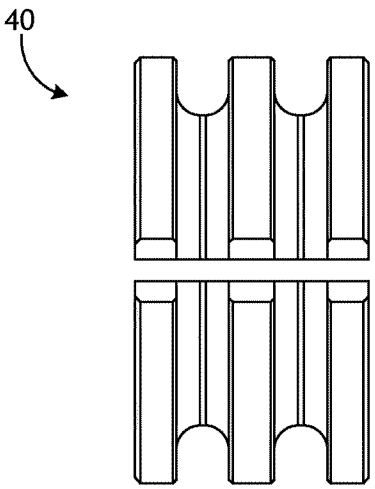
FIG. 5A is a side view of the clutch assembly shown in FIG. 1.

FIG. 5A is a side view of the clutch assembly 40 shown in FIG. 1. FIG. 5B is a top view of the clutch assembly 40 shown in FIG. 1. FIG. 5C is a perspective view of the clutch assembly 40 shown in FIG. 1. This particular clutch assembly functions as two halves as described above to exert a frictional force on dart 20 so as to prevent dart 20 from freely moving between its open and closed positions within the dart plunger of FIG. 1 as the plunger travels up/down the well bore.

Figure 6:
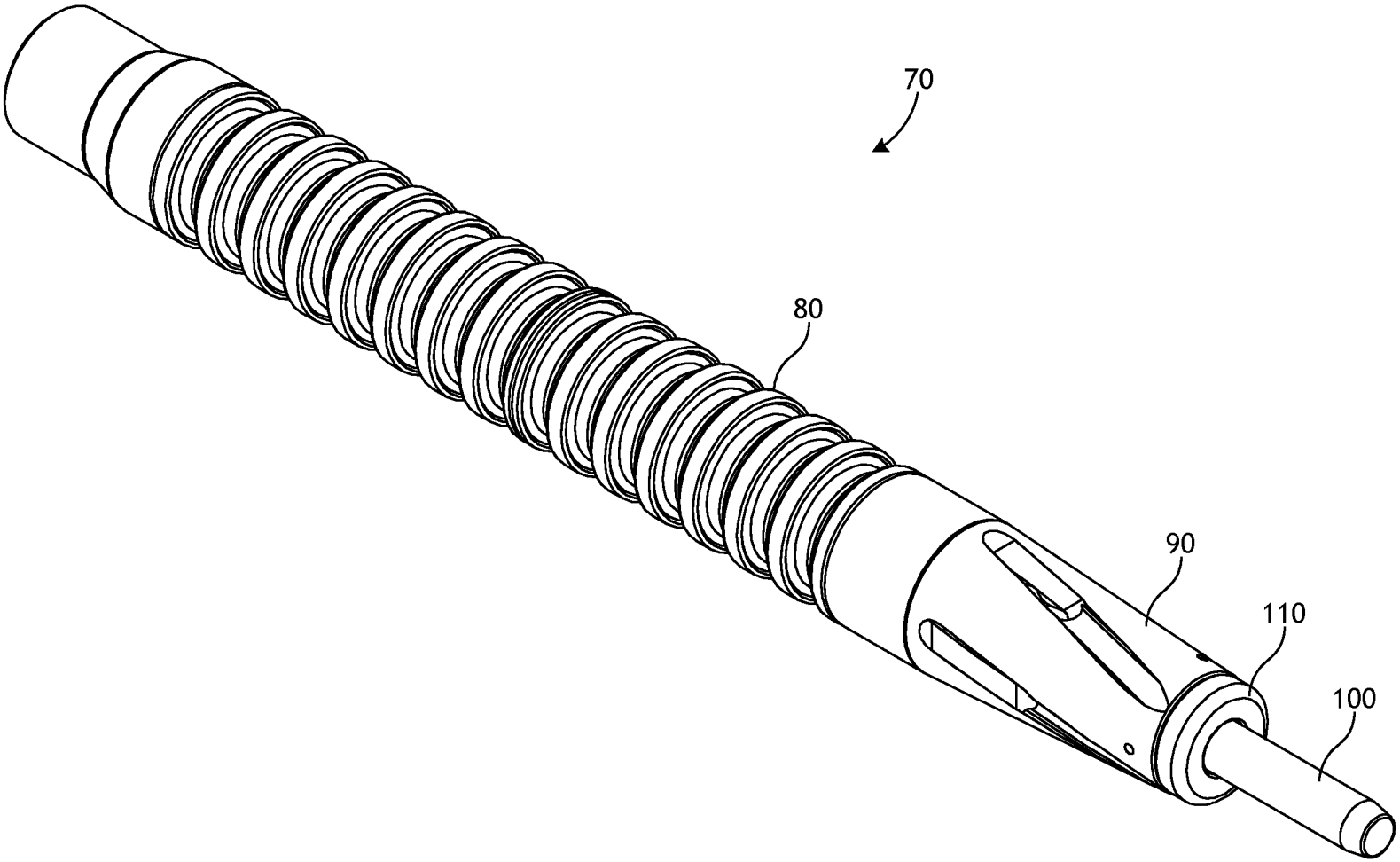
FIG. 6 is a perspective view of one embodiment of a dart plunger assembly including an exemplary embodiment of the present invention.

FIG. 6 is a perspective view of one embodiment of a dart plunger assembly including an exemplary embodiment of the present invention. Specifically, as shown, FIG. 6 depicts dart plunger 70, which includes plunger body 80, cage 90, dart 100, and end nut 110. As will be described in more detail below, dart plunger 70 includes at least an entirely new and different clutch mechanism (including various embodiments) over that of the dart plunger depicted in FIG. 1-5.

Figure 7:
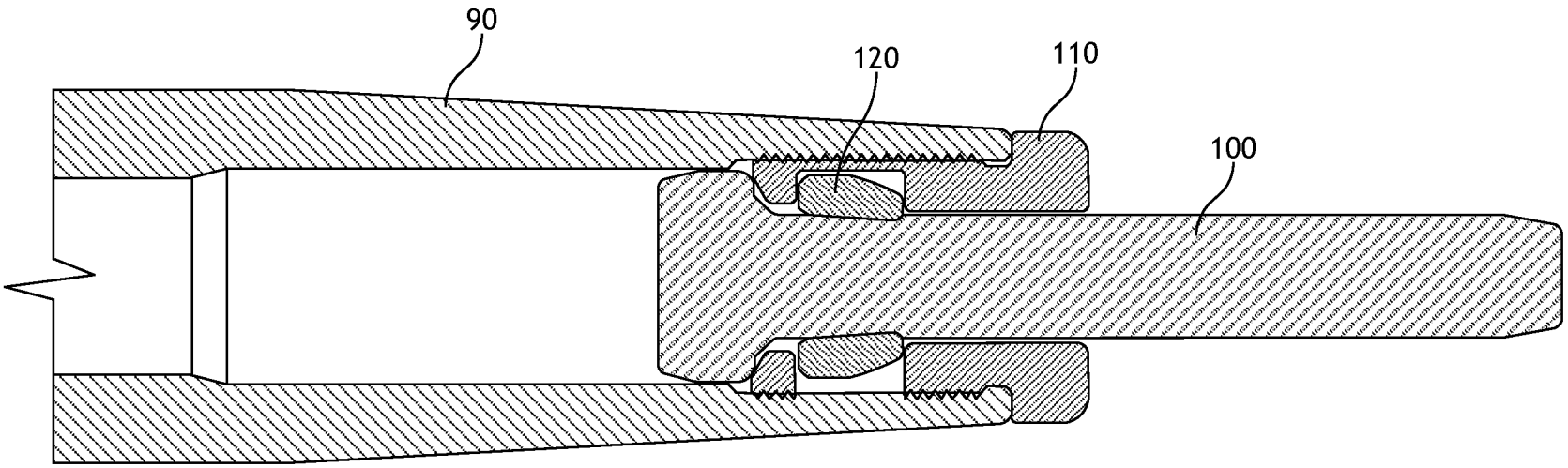
FIG. 7 is a partial cross-section view of the dart plunger assembly shown in FIG. 6.

FIG. 7 is a partial cross-section view of the new dart plunger assembly shown in FIG. 6. As shown, FIG. 7 illustrates the relationship between cage 90, dart 100, end nut 110, and clutch 120. Notably, end nut 110 is depicted as a uninut in that it now houses, or retains, clutch 120. Moreover, while clutch 120 is entirely different from the prior art clutches, the general operation of the cage 90, dart 100, clutch 120 and end nut 110 operate similar to a prior art dart plunger in the sense that dart 100 has an open and closed position within the dart plunger.

Figure 8B:
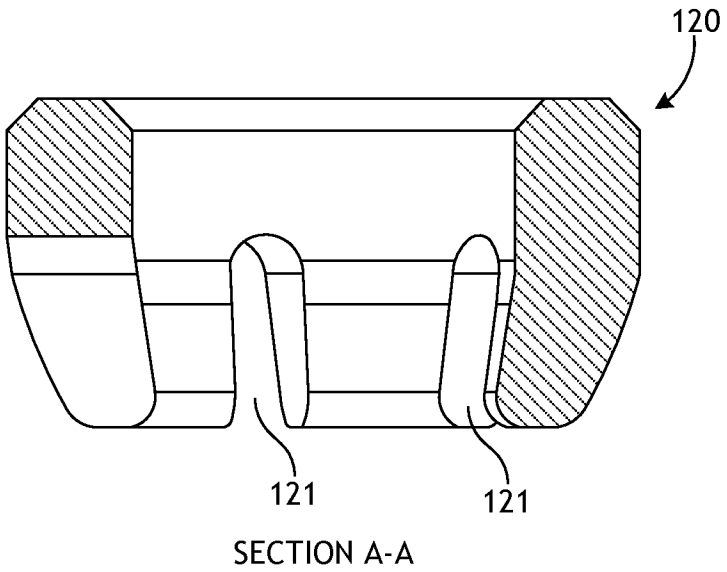
FIG. 8B is a cross-section view taken along cross-sectional line A-A shown in FIG. 8A.
Figure 8A:
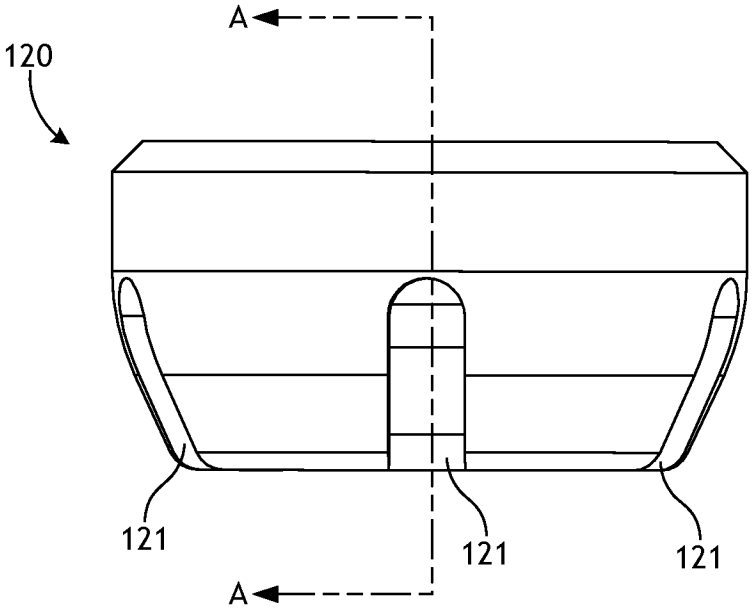
FIG. 8A is a side view of an exemplary embodiment of a clutch assembly of the present invention.

FIG. 8A is a side view of one embodiment of clutch 120 shown in FIG. 7. As shown, this embodiment of clutch 120 is a single element (i.e., it is not a multi-piece clutch like clutch 40) having a specific shape, sometimes referred to as a collet clutch. Namely, in this embodiment it is generally circular with at least one inside diameter sized to create a frictional interface with dart 100 and at least one outside diameter sized to seat snuggly in end nut 110. Still further, this embodiment of clutch 120 includes at least one or more slots 121 so that the entire inner circumference of clutch 120 is not imparting a frictional force on dart 100. Likewise, this embodiment of clutch 120 includes one or more tapered sides so, once again, the entire inner circumference of clutch 120 is not imparting a frictional force on dart 100. Both slots 121 and the tapering of the sides of clutch 120 function at least in part so that clutch 120 does not wear out as fast as it otherwise would without the slots and/or tapered sides.

FIG. 8B is a cross-section view taken along cross-sectional line A-A shown in FIG. 8A. FIG. 8B better depicts the varying inside and outside diameters of that embodiment of clutch 120 as well as slots 121.

Figure 9A:
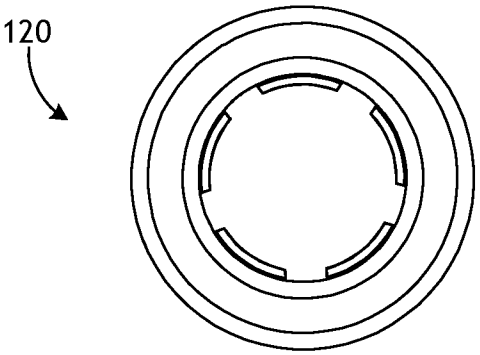
FIG. 9A is a top view of an exemplary embodiment of a clutch assembly of the present invention.
Figure 9B:
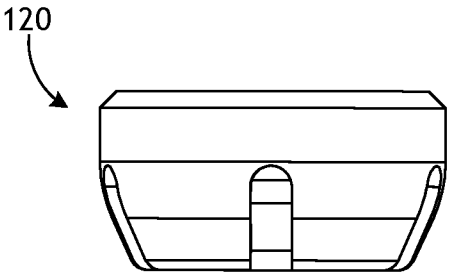
FIG. 9B is a side view of an exemplary embodiment of a clutch assembly of the present invention.
Figure 9C:
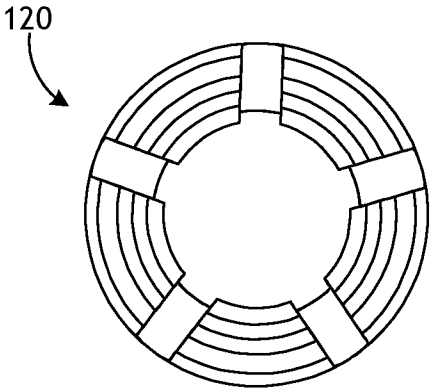
FIG. 9C is a bottom view of an exemplary embodiment of a clutch assembly of the present invention.
Figure 9D:
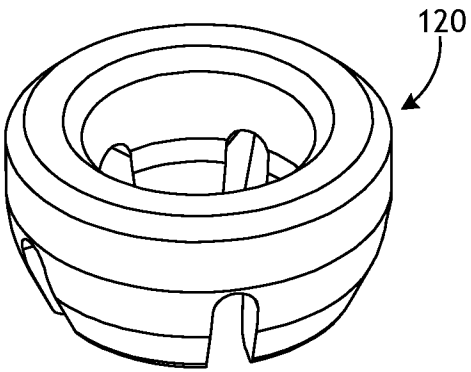
FIG. 9D is a perspective view of an exemplary embodiment of a clutch assembly of the present invention.

FIG. 9A is a top view of the embodiment of clutch 120 shown in FIGS. 8A and 8B. FIG. 9B is a side view of the embodiment of clutch 120 shown in FIGS. 8A and 8B. FIG. 9C is a bottom view of the embodiment of clutch 120 shown in FIGS. 8A and 8B. FIG. 9D is a perspective view of the embodiment of clutch 120 shown in FIGS. 8A and 8B. Like FIG. 8B, FIGS. 9A-9D better depict the varying inside and outside diameters of that embodiment of clutch 120 as well as slots 121.

Figure 10:
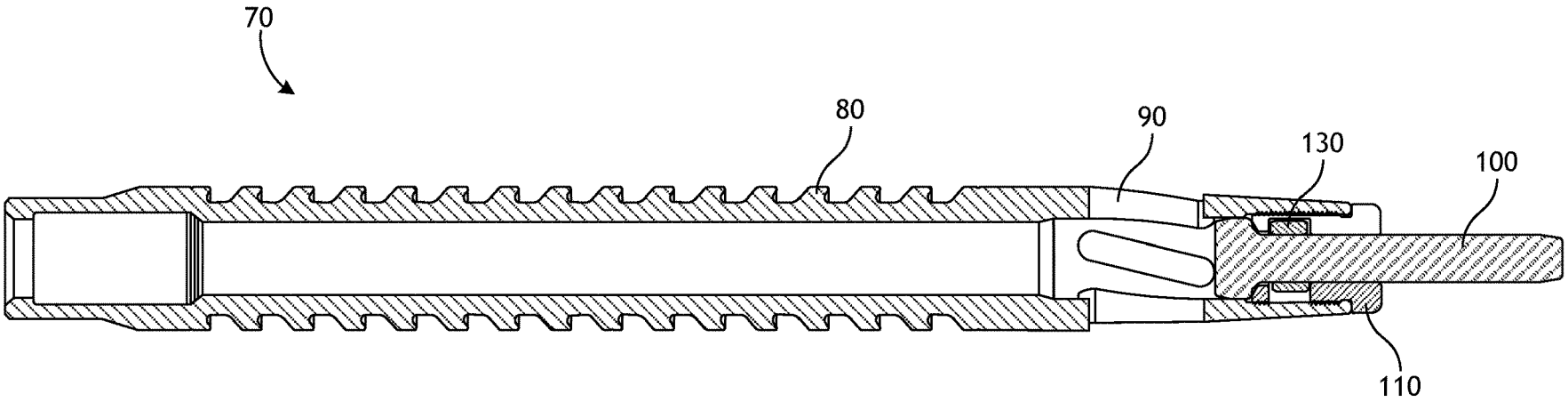
FIG. 10 is a cross-sectional view of an exemplary embodiment of a dart plunger assembly including an embodiment of the present invention.

FIG. 10 is a cross sectional view of another embodiment of a dart plunger assembly including another exemplary embodiment of the present invention. Specifically, as shown, FIG. 10 depicts dart plunger 70, which includes plunger body 80, cage 90, dart 100, and end nut 110. As will be described in more detail below, dart plunger 70 includes at least an entirely new and different clutch mechanism 130 (including various embodiments) over that of the dart plunger depicted in FIG. 1-5.

Figure 11:
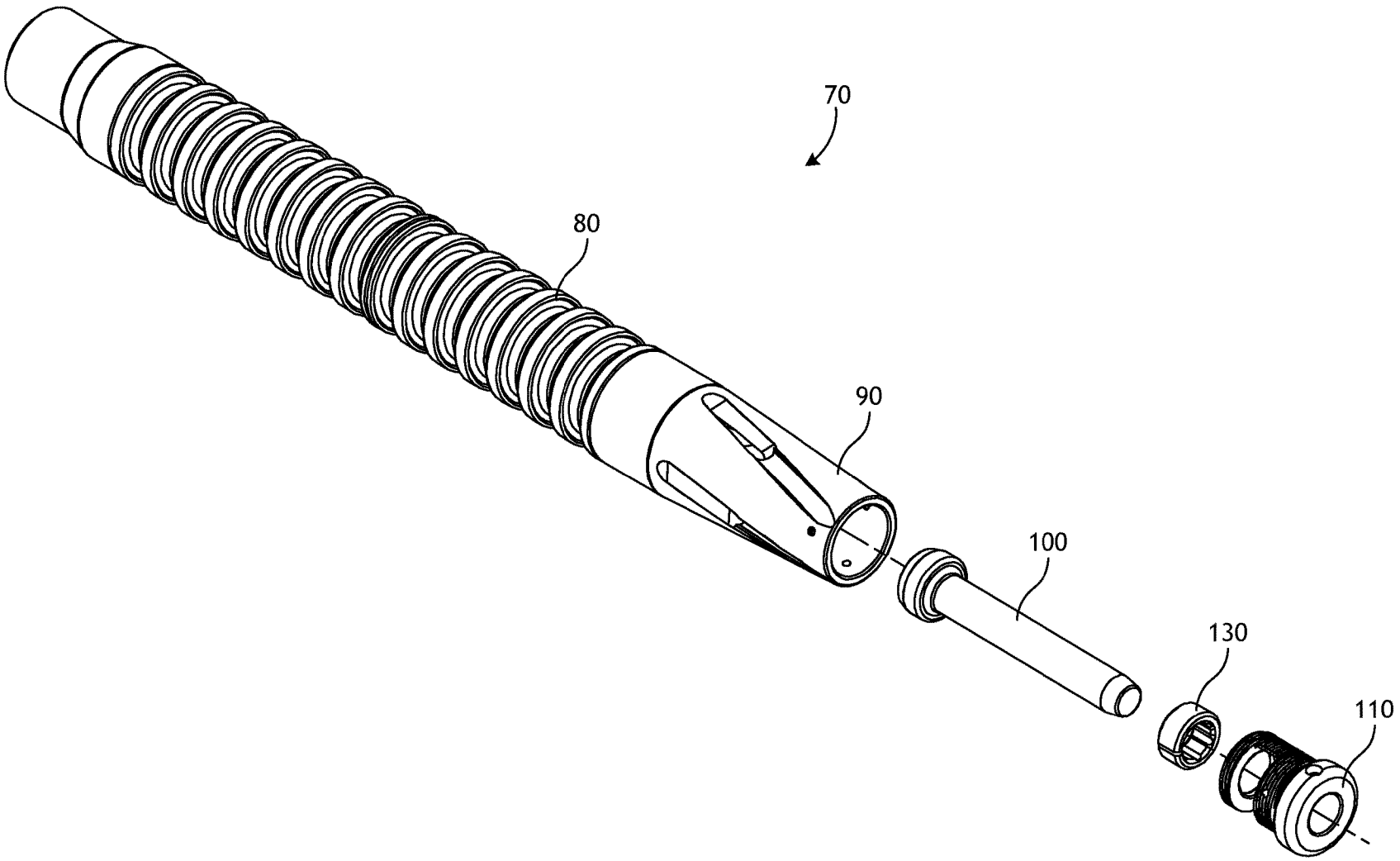
FIG. 11 is an assembly view of an exemplary embodiment of a dart plunger assembly including an embodiment of the present invention.
Figure 12:
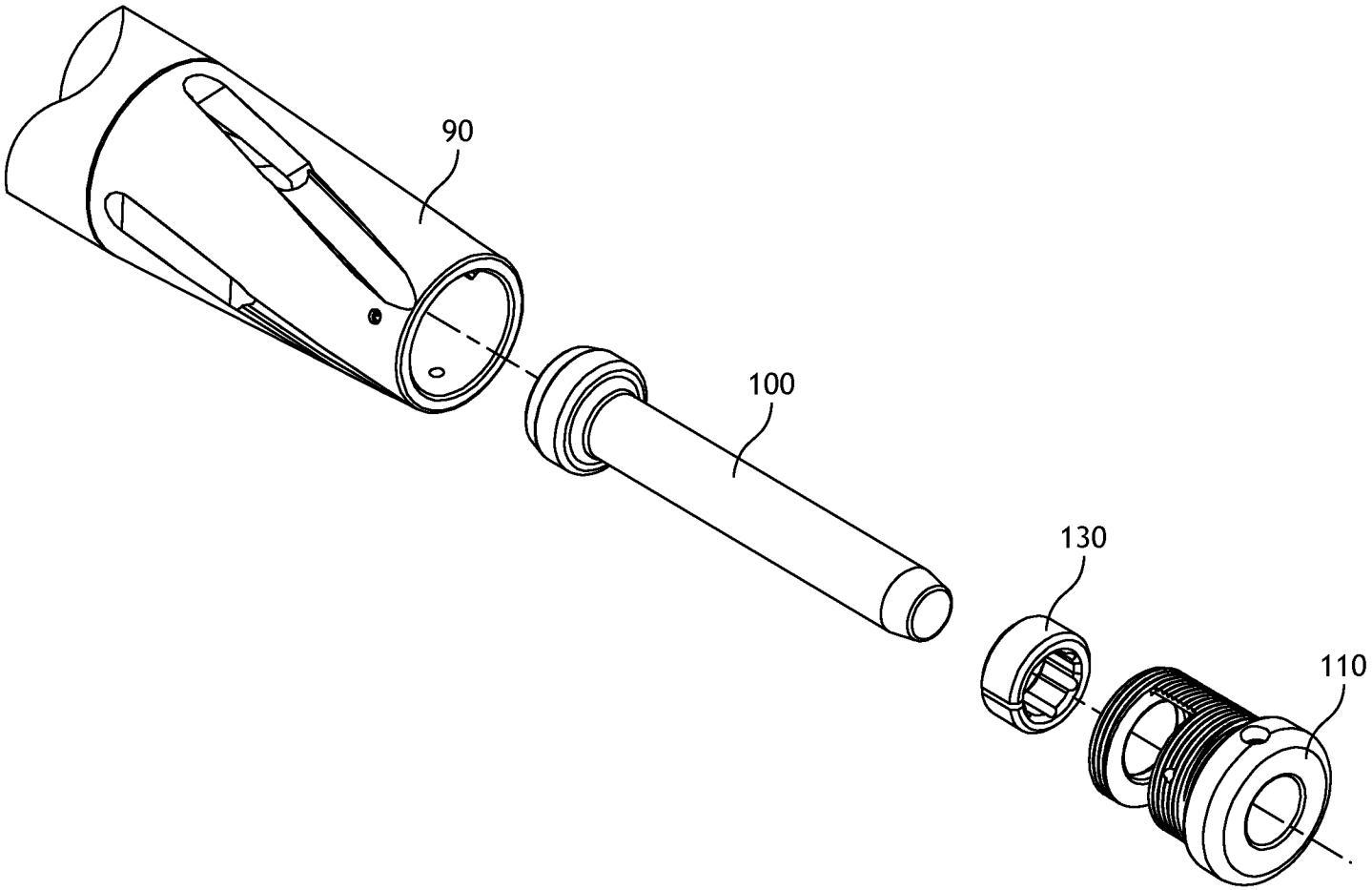
FIG. 12 is a partial assembly view of an exemplary embodiment of a dart plunger assembly including an embodiment of the present invention.

FIG. 11 is an assembly view of one embodiment of dart plunger 70 shown in FIG. 10. Specifically, FIG. 11 shows plunger body 80 coupled to cage 90. Further shown is the orientation in which dart 100 is inserted into cage 90, with clutch 130 to be mounted on dart 100, all of which is maintained in the body/cage combination by the threaded connection on end nut 110. See also FIG. 12, which illustrates the same detail. Note that this embodiment shows end nut 110 having a partial cutout in its sidewall. The purpose of this cutout is so that clutch 130 can be inserted into end nut 110 through the cutout. This same feature is shown in FIG. 7.

Figure 13:
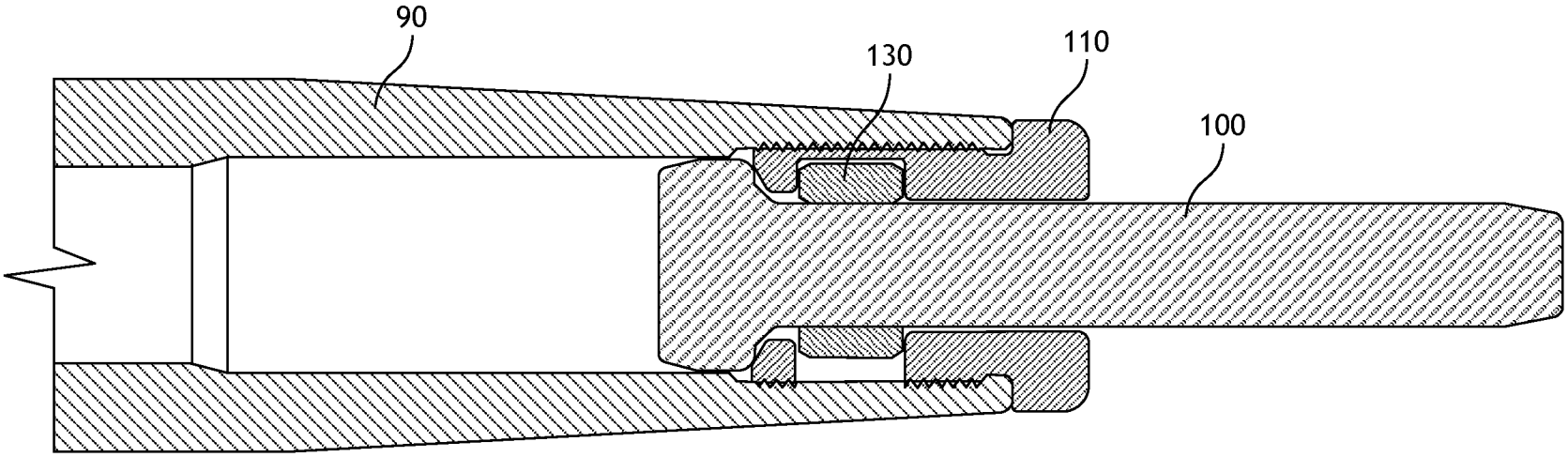
FIG. 13 is a partial cross-section view of the dart plunger assembly shown in FIG. 11.

FIG. 13 is a partial cross-section view of the dart plunger assembly shown in FIG. 10. As shown, FIG. 13 illustrates the relationship between cage 90, dart 100, end nut 110, and clutch 130. While clutch 130 is entirely different from the prior art clutches, the general operation of the cage 90, dart 100, clutch 130 and end nut 110 operate similar to a prior art dart plunger in the sense that dart 100 has an open and closed position within the dart plunger.

Figure 14C:
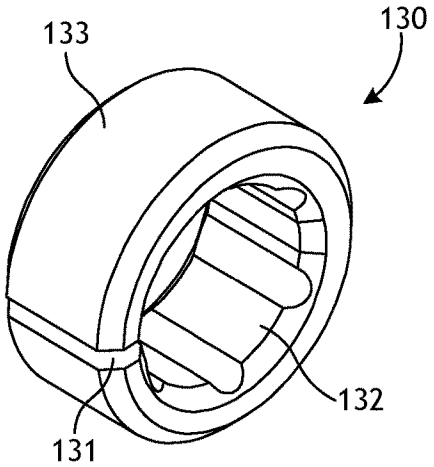
FIG. 14C is a perspective view of an exemplary embodiment of a clutch assembly of the present invention.
Figure 14A:
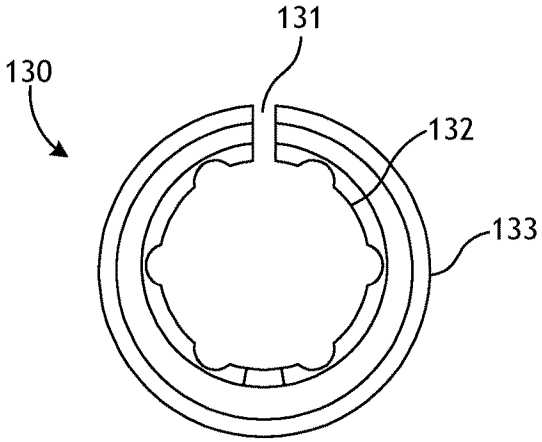
FIG. 14A is a top view of an exemplary embodiment of a clutch assembly of the present invention.
Figure 14B:
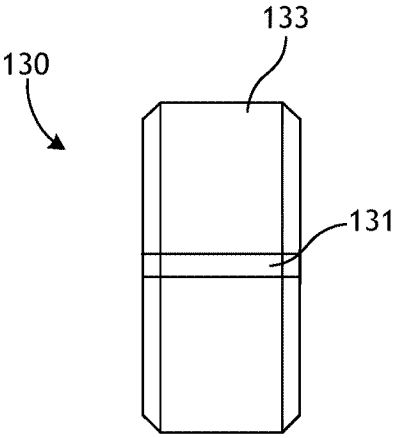
FIG. 14B is a side view of an exemplary embodiment of a clutch assembly of the present invention.

FIG. 14A is a top view of the embodiment of clutch 130 shown in FIGS. 10-13. FIG. 14B is a side view of the embodiment of clutch 130 shown in FIGS. 10-13. FIG. 14C is a perspective view of the embodiment of clutch 130 shown in FIGS. 10-13.

As shown in FIGS. 14A-14C, this embodiment of clutch 130 has a particular shape and characteristics. Namely, this embodiment of clutch 130 includes a slit or gap 131, which as shown extends from the outside diameter to the inside diameter of clutch 130 along its entire length. One purpose of this gap is to give it some flexibility so, for example, the clutch can be spread open to fit onto the outside diameter of the dart. Moreover, this embodiment of clutch 130 includes outer surface/diameter 133 that in this embodiment is uniform and sized to snuggly fit within end nut 110 and/or cage 90. This embodiment of clutch 130 also includes undulating inside surface/diameter 132. In other embodiments, the inside surface/diameter 132 is not undulating. The purpose of undulating inside surface/diameter 132 is at least so the entire inside surface/diameter of clutch 130 does not contact dart 100. Finally, as best illustrated by FIG. 14A, the center point (or origin) of the outside diameter of clutch 130 is not the same as the center point (or origin) of the inside diameter of clutch 130. As shown, the sidewall of clutch 130 opposite gap 131 is thicker than the sidewall of clutch 130 at gap 131. Accordingly, the thicker sidewall opposite gap 131 is less inclined to crack or break since it is thicker in that region than in other regions of clutch 130, which is believed to be an advantage since the side of clutch 130 opposite gap 131 receives more stress than other regions of clutch 130 due to its location opposite gap 131. That said, other embodiments of clutch 130 include inside and outside diameters on the same center.

Figure 15:
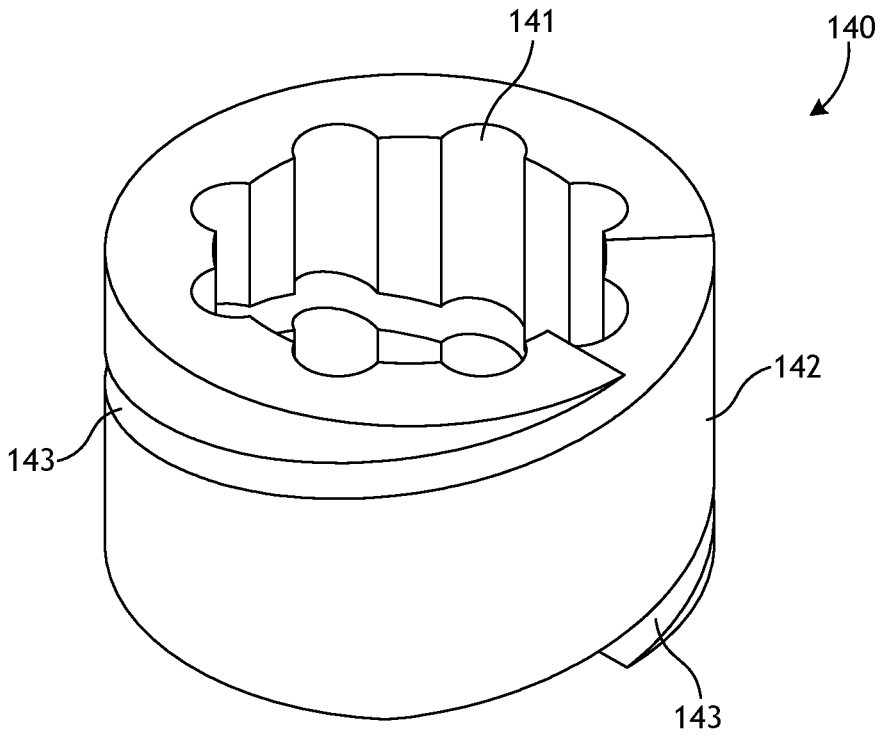
FIG. 15 is a perspective view of an exemplary embodiment of a clutch assembly of the present invention.

FIG. 15 is a perspective view of yet another embodiment of a clutch 140 for use in a dart plunger. As shown, this particular embodiment of clutch 140 has an undulating inside diameter 141 akin to that of clutch 130 shown in FIGS. 10-14 in that it includes at least one inside diameter sized to create a frictional interface with dart 100. Unlike the embodiment of clutch 130, however, this embodiment of clutch 140 includes an outside diameter 142 (than can be smooth or not, i.e., ribbed) that is further characterized by spiral cut 143, which in this embodiment begins on the top surface of clutch 140 and ends on the bottom surface of clutch 140. The outside diameter of clutch 140 is sized to seat snuggly in either end nut 110 or within cage 90. Other embodiments of clutch 140 are contemplated as specifically within the scope of the present invention. For example, spiral cut 143 need not extend from the top to the bottom of clutch 140. Likewise, the inside diameter of clutch 140 need not include undulating surface 141.

Figure 16:
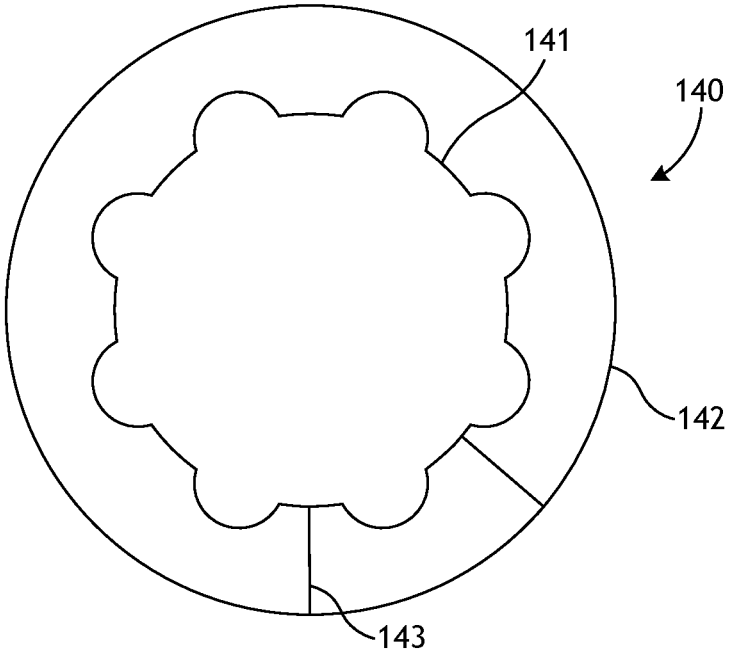
FIG. 16 is a top view of the embodiment of FIG. 15.
Figure 17:
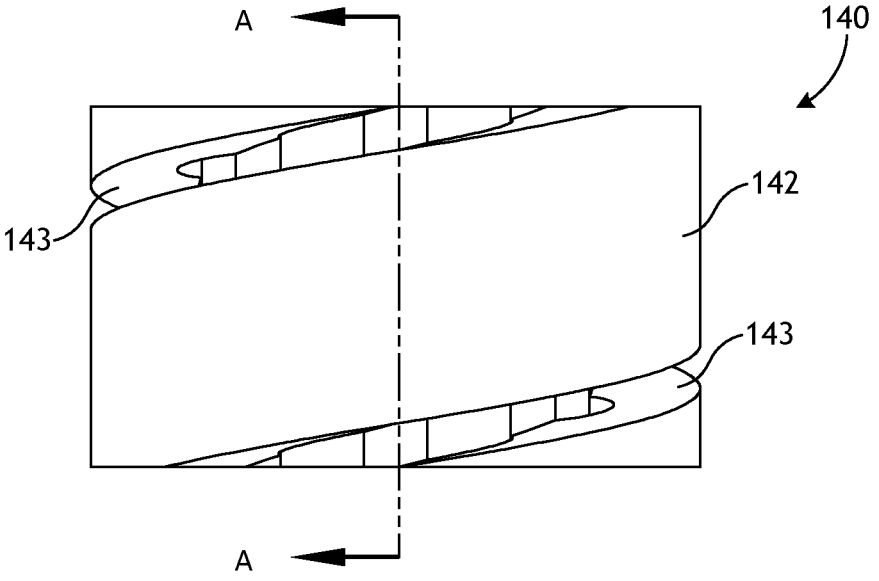
FIG. 17 is a front view of the embodiment of FIG. 15, including cross section line A-A.
Figure 18:
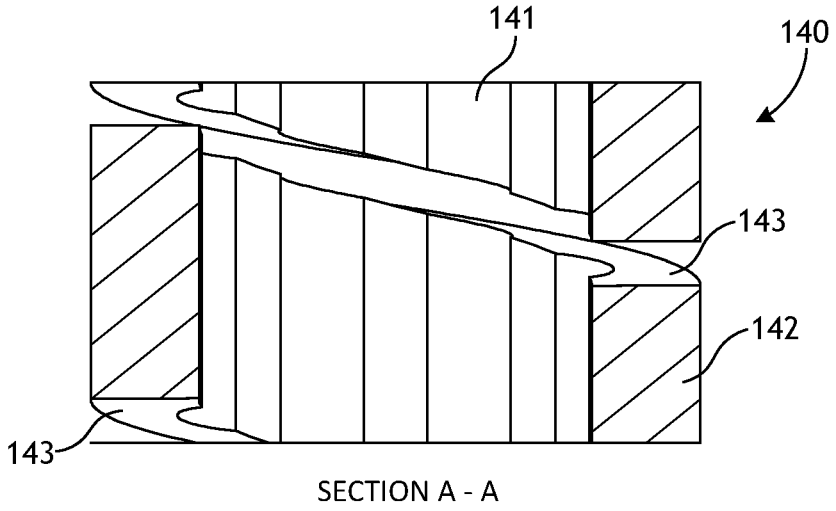
FIG. 18 is a cross-sectional view of FIG. 17 taken along cross section line A-A in FIG. 17.

FIG. 16 is a top view of the embodiment of FIG. 15. Once again, this particular embodiment of clutch 140 is shown including undulating inside diameter 141, outside diameter 142, and the beginning (on the top surface) of spiral cut 143. Likewise, FIG. 17 is a front view of the embodiment of FIG. 15, including cross section line A-A. Once again, outside diameter 142 and spiral cut 143 are visible. FIG. 18 is a cross-sectional view of FIG. 17 taken along cross section line A-A in FIG. 17 to once again illustrate undulating inside diameter 141, outside diameter 142, and spiral cut 143.

Figure 19:
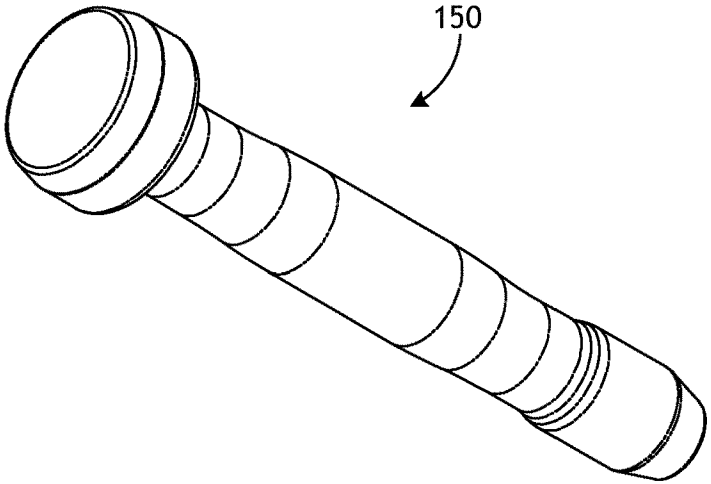
FIG. 19 is a perspective view of an exemplary embodiment of a dart of the present invention.

FIG. 19 is a perspective view of one exemplary embodiment of dart 100 of the present invention. While other embodiments of dart 100 previously depicted as part of the present invention show dart 100 as having a shaft of substantially constant diameter (see FIGS. 6, 7, 10, 11, 12, and 13), FIGS. 19-23 illustrate yet another embodiment of the dart of the present invention. Specifically, FIG. 19 illustrates dart 150 as having a shaft whose diameter varies from end to end, namely in this embodiment the shaft has a smaller diameter toward its opposite ends and a larger diameter between its opposite ends. (Note that as shown in FIGS. 19-23, the term "opposite ends" does not necessarily mean the absolute ends of the dart.) One idea is that the shaft experiences more friction with its corresponding clutch toward the middle of the shaft than it does at other portions of the shaft, such as toward the opposite ends of the shaft. This reduces tension and/or wear on the clutch when compared to a shaft of constant diameter since the dart only transitions between its open and closed positions a fraction of the time that it is in use.

Figure 20:
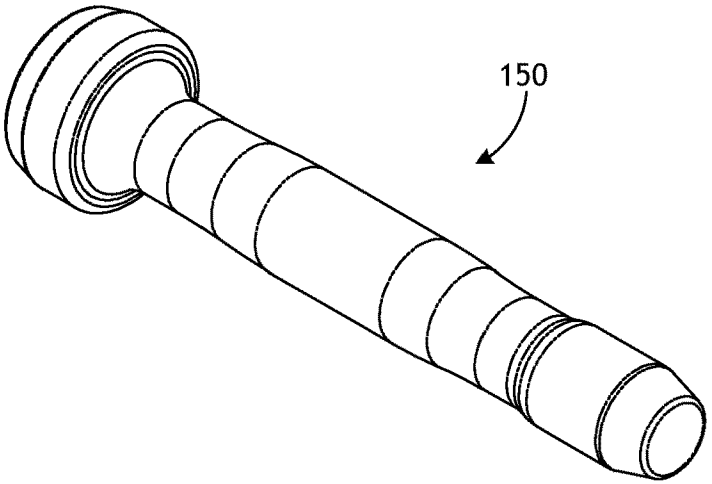
FIG. 20 is a perspective view of an exemplary embodiment of a dart of the present invention.
Figure 22:
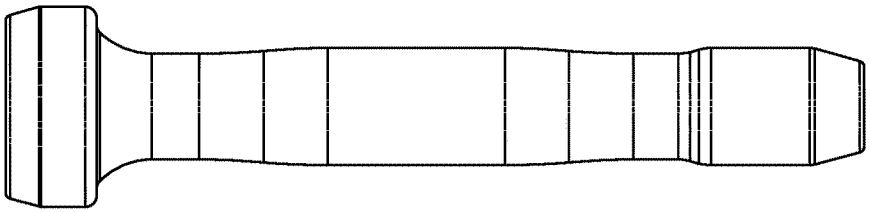
FIG. 22 is a side view of an exemplary embodiment of a dart of the present invention.
Figure 23:
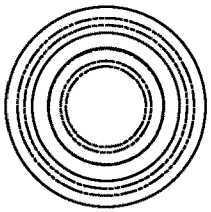
FIG. 23 is a bottom view of an exemplary embodiment of a dart of the present invention.
Figure 21:
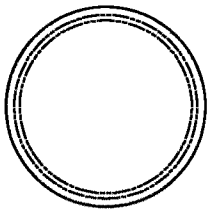
FIG. 21 is a top view of an exemplary embodiment of a dart of the present invention.

FIG. 20 is another perspective view of this particular embodiment of dart 150. FIG. 21 is a top view of the same embodiment. FIG. 22 is a side view, and FIG. 23 is a bottom view of the same embodiment. Put differently, each embodiment of FIGS. 19-23 include a dart shaft having a central region of increased diameter relative to other regions of the dart's shaft.

Further elaborating on the disclosed characteristics of the exemplary dart of FIGS. 19-23 is the relationship between at least one of the areas of reduced diameter of the dart's shaft relative to the height dimension of the clutch. The "height" of the clutch is defined as the distance between the bottom and top of the clutch as it is sitting in its operational position in a plunger deployed in a well. Specifically, as indicated above, the shaft of the dart can have a first region of reduced diameter and optionally additional regions of reduced diameter relative to other regions of the dart's shaft. A first region of reduced diameter can be between the head of the dart and an area of increased diameter such as, in this exemplary case, near the middle portion of the dart as shown in FIGS. 19-23. In an embodiment, the length of this first region of reduced diameter is greater than the height of the clutch by an amount desired by the designer as discussed further below. Applicants have designed the difference to be approximately ⅛ inch, but other measurements (larger or smaller) are possible depending on the amount of relative "play" (or relatively free movement) of the dart between what is described below as the dart's minimum closed position and the dart's maximum closed position.

One reason for the differential in length between the length of the first region of reduced diameter and the height of the clutch is because it is desired that the dart move more freely in this region. As described above, the dart will move more freely in this region because the reduced diameter of the dart correspondingly reduces the amount of friction between the dart and the clutch. As such, the dart will move more freely between a maximum closed position (i.e., when the dart is in sealing contact with the bore of the plunger) and a minimum closed position (i.e., when the dart is not in sealing contact with the bore of the plunger). The distance between the maximum closed position and the minimum closed position is substantially the same as the difference between the length of the dart's first region of reduced diameter and the height of the clutch.

In operation, as described above, the plunger will travel up the wellbore when its dart is in its maximum closed position and the pressure below the plunger is sufficiently greater than the pressure above the plunger. As the plunger travels up the wellbore, it may experience pressure changes due to pockets of gas, liquid, or other reasons that will be understood by those skilled in the art. In the event the pressure change is such that the pressure below the plunger is not sufficiently greater than the pressure above the plunger to drive the plunger toward the surface, the plunger may stall and/or begin to fall back down the wellbore. In this scenario, due to the differential in length between the length of the first region of reduced diameter and the height of the clutch, the dart is able to move from its maximum closed position to its minimum closed position, thereby allowing the flow of the well to flush the plunger's clutch mechanism and bore of sand or other debris deleterious to the operation and longevity of the plunger.

When the pressure again changes such that the pressure below the plunger is sufficiently greater than the pressure above the plunger, such pressure differential will cause the plunger's dart to move from its minimum closed position to its maximum closed position. As such, closure of the dart is not entirely dependent on the plunger striking a bottom stop in the well, as in the prior art, but rather movement of the dart—between its maximum closed position and its minimum closed position—can be controlled by well conditions when the clutch is positioned in this area of reduced dart diameter. Those skilled in the art will appreciate that these pressure changes (that cause the plunger's dart to move between is minimum and maximum closed positions) can be various and can occur rapidly, such that the path of the plunger to the surface is not always steady or constant. It has been observed and it is believed, however, that the ability of the dart to move between is minimum and maximum closed positions at least results in more consistent plunger runs than those without it.

Although the invention(s) is/are described herein with reference to specific embodiments, various modifications and changes can be made without departing from the scope of the present invention(s), as set forth in the claims below. Accordingly, the specification and Figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

Accordingly, the protection sought herein is as set forth in the claims below.

The invention claimed is:

1. A dart plunger for removing liquids in a well, comprising:

a body having a bore there-through;

a dart having a shaft, where the dart is mounted in the bore to move between a first open position and a first closed position, where a flow from the well travels through the bore in the first open position, and the flow from the well does not travel through the bore in the first closed position; and a clutch having a height;

wherein the dart's shaft has a first end, a second end, a first area of increased diameter between the first end and the second end, and a distance between the first end and the first area of increased diameter;

wherein the distance between the first end of the shaft and the first area of increased diameter is longer than the height of the clutch;

wherein the dart has a maximum closed position, a minimum closed position, and a distance between the maximum closed position and the minimum closed position, where the dart blocks the flow through the bore in the maximum closed position, and the dart allows the flow through the bore in the minimum closed position;

wherein the clutch engages the dart's shaft for retarding movement of the dart such that the clutch retards movement of the dart more at the first area of increased diameter than between the dart's first end and the first area of increased diameter; and wherein the distance between the maximum closed position and the minimum closed position is substantially the same as a difference between the height of the clutch and the distance between the dart's first end and the first area of increased diameter.

2. The dart plunger of claim 1 wherein the dart is mounted in the bore such that the dart moves between the maximum closed position and the minimum closed position in response to pressure fluctuations in the well.

3. The dart plunger of claim 2 wherein the first closed position of the dart and the maximum closed position of the dart are the same position.

4. The dart plunger of claim 3 wherein the dart includes a head at the second end.

5. The dart plunger of claim 4 wherein the dart is mounted in the bore using an end nut.

6. The dart plunger of claim 5 wherein the dart's shaft has a second area of increased diameter.

7. The dart plunger of claim 6 wherein the clutch is a one-piece unit having at least one inside diameter sized to create a frictional interface with the dart and at least one slot so that the entire at least one inside diameter of the clutch does not impart a frictional force on the dart.

8. The dart plunger of claim 6 wherein the clutch is a one-piece unit having an outside diameter and an inside diameter, where the inside diameter is sized to create a frictional interface with the dart, and wherein the clutch further includes a gap extending from the outside diameter to the inside diameter along the entire height of the clutch.

9. The dart plunger of claim 6 wherein the clutch is a one-piece unit having an outside diameter and an inside diameter, where the inside diameter is sized to create a frictional interface with the dart, and wherein the clutch includes a spiral cut in at least a portion of the outside diameter of the clutch.

10. The dart plunger of claim 9 wherein the clutch is mounted at least partially in the end nut.

11. The dart plunger of claim 1 wherein the first end includes a second area of increased diameter.

12. The dart plunger of claim 1 wherein the clutch is a one-piece unit having at least one inside diameter sized to create a frictional interface with the dart and at least one slot so that the entire at least one inside diameter of the clutch does not impart a frictional force on the dart.

13. The dart plunger of claim 1 wherein the clutch is a one-piece unit having an outside diameter and an inside diameter, where the inside diameter is sized to create a frictional interface with the dart, and wherein the clutch further includes a gap extending from the outside diameter to the inside diameter along the entire height of the clutch.

14. A dart plunger for descending and ascending in a well to remove liquids in the well, comprising:

a body having a bore there-through;

a dart having a shaft, where the dart is mounted in the bore to move between a first open position and a first closed position, where a flow from the well travels through the bore in the first open position, and the flow from the well does not travel through the bore past the dart in the first closed position; and a clutch having a height;

wherein the dart's shaft has a first end, a second end, a first area of increased diameter between the first end and the second end, and a distance between the first end and the first area of increased diameter;

wherein the distance between the first end of the shaft and the first area of increased diameter is longer than the height of the clutch;

wherein the dart has a maximum closed position, a minimum closed position, and a distance between the maximum closed position and the minimum closed position, where the dart blocks the flow through the bore in the maximum closed position, and the dart allows the flow through the bore in the minimum closed position;

wherein the clutch engages the dart's shaft for retarding movement of the dart such that the clutch retards movement of the dart more at the first area of increased diameter than between the dart's first end and the first area of increased diameter, and wherein the dart is mounted in the bore such that, as the plunger ascends in the well, the dart moves between the maximum closed position and the minimum closed position in response to pressure fluctuations in the well.

15. The dart plunger of claim 14 wherein the first closed position of the dart and the maximum closed position of the dart are the same position.

16. The dart plunger of claim 15 wherein the dart includes a head at the second end.

17. The dart plunger of claim 16 wherein the dart is mounted in the bore using an end nut.

18. The dart plunger of claim 17 wherein the dart's shaft has a second area of increased diameter.

19. The dart plunger of claim 18 wherein the clutch is a one-piece unit having an outside diameter and at least one inside diameter sized to create a frictional interface with the dart, and at least one slot in the at least one inside diameter so that the entire at least one inside diameter of the clutch does not impart a frictional force on the dart.

20. The dart plunger of claim 18 wherein the clutch is a one-piece unit having an outside diameter and an inside diameter, where the inside diameter is sized to create a frictional interface with the dart, and wherein the clutch further includes a gap extending from the outside diameter to the inside diameter along the entire height of the clutch.

21. The dart plunger of claim 18 wherein the clutch is a one-piece unit having an outside diameter and an inside diameter, where the inside diameter is sized to create a frictional interface with the dart, and wherein the clutch includes a spiral cut in at least a portion of the outside diameter of the clutch.

22. The dart plunger of claim 21 wherein the clutch is mounted at least partially in the end nut.

23. The dart plunger of claim 14 wherein the first end includes a second area of increased diameter.

24. The dart plunger of claim 14 wherein the clutch is a one-piece unit having an outside diameter and at least one inside diameter sized to create a frictional interface with the dart, and at least one slot in the at least one inside diameter so that the entire at least one inside diameter of the clutch does not impart a frictional force on the dart.

25. The dart plunger of claim 14 wherein the clutch is a one-piece unit having an outside diameter and an inside diameter, where the inside diameter is sized to create a frictional interface with the dart, and wherein the clutch further includes a gap extending from the outside diameter to the inside diameter along the entire height of the clutch.

26. The dart plunger of claim 14 wherein the clutch is a one-piece unit having an outside diameter and an inside diameter, where the inside diameter is sized to create a frictional interface with the dart, and wherein the clutch includes a spiral cut in at least a portion of the outside diameter of the clutch.

27. The dart plunger of claim 1 wherein the clutch is a one-piece unit having an outside diameter and an inside diameter, where the inside diameter is sized to create a frictional interface with the dart, and wherein the clutch includes a spiral cut in at least a portion of the outside diameter of the clutch.

28. A dart plunger for descending and ascending in a well to remove liquids in the well, comprising:

a body having a bore there-through;

a dart having a shaft, where the dart is mounted in the bore to move between a first open position and a first closed position, where a flow from the well travels through the bore in the first open position, and the flow from the well does not travel through the bore past a closed end of the dart in the first closed position; and a clutch;

wherein the dart's shaft has a first end, a second end, and a first area of increased diameter between the first end and the second end;

wherein the dart has a maximum closed position and a minimum closed position, where the dart blocks the flow through the bore past the closed end of the dart in the maximum closed position, and the dart allows the flow through the bore in the minimum closed position;

wherein the clutch engages the dart's shaft for retarding movement of the dart such that the clutch retards movement of the dart more at the first area of increased diameter than between the dart's first end and the first area of increased diameter; and wherein the dart is mounted in the bore such that, as the plunger ascends in the well, the dart moves between the maximum closed position and the minimum closed position in response to pressure fluctuations in the well.

29. The dart plunger of claim 28 wherein the first closed position of the dart and the maximum closed position of the dart are the same position.

30. The dart plunger of claim 29 wherein the dart includes a head at the second end.

31. The dart plunger of claim 30 wherein the dart is mounted in the bore using an end nut.

32. The dart plunger of claim 31 wherein the dart's shaft has a second area of increased diameter.

33. The dart plunger of claim 32 wherein the clutch is a one-piece unit having an outside diameter and at least one inside diameter sized to create a frictional interface with the dart, and at least one slot in the at least one inside diameter so that the entire at least one inside diameter of the clutch does not impart a frictional force on the dart.

34. The dart plunger of claim 32 wherein the clutch is a one-piece unit having an outside diameter and an inside diameter and a height, where the inside diameter is sized to create a frictional interface with the dart, and wherein the clutch further includes a gap extending from the outside diameter to the inside diameter along the height of the clutch.

35. The dart plunger of claim 32 wherein the clutch is a one-piece unit having an outside diameter and an inside diameter, where the inside diameter is sized to create a frictional interface with the dart, and wherein the clutch includes a spiral cut in at least a portion of the outside diameter of the clutch.

36. The dart plunger of claim 28 wherein the clutch is a one-piece unit having an outside diameter and at least one inside diameter sized to create a frictional interface with the dart, and at least one slot in the at least one inside diameter so that the entire at least one inside diameter of the clutch does not impart a frictional force on the dart.

37. The dart plunger of claim 28 wherein the clutch is a one-piece unit having an outside diameter and an inside diameter and a height, where the inside diameter is sized to create a frictional interface with the dart, and wherein the clutch further includes a gap extending from the outside diameter to the inside diameter along the height of the clutch.

38. The dart plunger of claim 28 wherein the clutch is a one-piece unit having an outside diameter and an inside diameter, where the inside diameter is sized to create a frictional interface with the dart, and wherein the clutch includes a spiral cut in at least a portion of the outside diameter of the clutch.

39. A dart plunger for descending and ascending in a well to remove liquids in the well, comprising:

a body having a bore there-through;

a dart mounted in the bore to move between a first open position and a first closed position, where a flow from the well travels through the bore in the first open position, and the flow from the well does not travel through the bore in the first closed position;

wherein the dart is mounted in the bore to move between a maximum closed position and a minimum closed position, where the dart blocks flow through the bore in the maximum closed position, and the dart allows flow through the bore in the minimum closed position; and wherein the dart is mounted in the bore such that, as the plunger ascends in the well, the dart moves between the maximum closed position and the minimum closed position in response to pressure fluctuations in the well.

40. The dart plunger of claim 39 including a clutch.

41. The dart plunger of claim 40 wherein the dart includes a shaft having a first end, a second end, and a first area of increased diameter between the first end and the second end.

42. The dart plunger of claim 41 wherein the clutch engages the dart's shaft for retarding movement of the dart such that the clutch retards movement of the dart more at the first area of increased diameter than between the dart's first end and the first area of increased diameter.

43. The dart plunger of claim 42 wherein the first closed position of the dart and the maximum closed position of the dart are the same position.

44. The dart plunger of claim 43 wherein the clutch is a one-piece unit having an outside diameter and at least one inside diameter sized to create a frictional interface with the dart, and at least one slot in the at least one inside diameter so that the entire at least one inside diameter of the clutch does not impart a frictional force on the dart.

45. The dart plunger of claim 43 wherein the clutch is a one-piece unit having an outside diameter and an inside diameter and a height, where the inside diameter is sized to create a frictional interface with the dart, and wherein the clutch further includes a gap extending from the outside diameter to the inside diameter along the height of the clutch.

46. The dart plunger of claim 43 wherein the clutch is a one-piece unit having an outside diameter and an inside diameter, where the inside diameter is sized to create a frictional interface with the dart, and wherein the clutch includes a spiral cut in at least a portion of the outside diameter of the clutch.

47. The dart plunger of claim 39 wherein the clutch is a one-piece unit having an outside diameter and at least one inside diameter sized to create a frictional interface with the dart, and at least one slot in the at least one inside diameter so that the entire at least one inside diameter of the clutch does not impart a frictional force on the dart.

48. The dart plunger of claim 39 wherein the clutch is a one-piece unit having an outside diameter and an inside diameter and a height, where the inside diameter is sized to create a frictional interface with the dart, and wherein the clutch further includes a gap extending from the outside diameter to the inside diameter along the height of the clutch.

49. The dart plunger of claim 39 wherein the clutch is a one-piece unit having an outside diameter and an inside diameter, where the inside diameter is sized to create a frictional interface with the dart, and wherein the clutch includes a spiral cut in at least a portion of the outside diameter of the clutch.

50. A dart plunger for descending and ascending in a well to remove liquids in the well, comprising:

a body having a bore there-through;

a dart mounted in the bore to move between a first open position and a first closed position, where a flow from the well travels past the dart and through the bore in the first open position, and the flow from the well does not travel past the dart and through the bore in the first closed position;

wherein the dart is mounted in the bore to move between a maximum closed position and a minimum closed position, where the dart blocks flow past the dart and through the bore in the maximum closed position, and the dart allows flow past the dart and through the bore in the minimum closed position; and wherein the dart is mounted in the bore such that, as the plunger ascends in the well, the dart moves between the maximum closed position and the minimum closed position in response to pressure fluctuations in the well.

51. The dart plunger of claim 50 including a clutch.

52. The dart plunger of claim 51 wherein the dart includes a shaft having a first end, a second end, and a first area of increased diameter between the first end and the second end.

53. The dart plunger of claim 52 wherein the clutch engages the dart's shaft for retarding movement of the dart such that the clutch retards movement of the dart more at the first area of increased diameter than between the dart's first end and the first area of increased diameter.

54. The dart plunger of claim 53 wherein the first closed position of the dart and the maximum closed position of the dart are the same position.

55. The dart plunger of claim 54 wherein the clutch is a one-piece unit having an outside diameter and at least one inside diameter sized to create a frictional interface with the dart, and at least one slot in the at least one inside diameter so that the entire at least one inside diameter of the clutch does not impart a frictional force on the dart.

56. The dart plunger of claim 54 wherein the clutch is a one-piece unit having an outside diameter and an inside diameter and a height, where the inside diameter is sized to create a frictional interface with the dart, and wherein the clutch further includes a gap extending from the outside diameter to the inside diameter along the height of the clutch.

57. The dart plunger of claim 54 wherein the clutch is a one-piece unit having an outside diameter and an inside diameter, where the inside diameter is sized to create a frictional interface with the dart, and wherein the clutch includes a spiral cut in at least a portion of the outside diameter of the clutch.

58. The dart plunger of claim 51 wherein the clutch is a one-piece unit having an outside diameter and at least one inside diameter sized to create a frictional interface with the dart, and at least one slot in the at least one inside diameter so that the entire at least one inside diameter of the clutch does not impart a frictional force on the dart.

59. The dart plunger of claim 51 wherein the clutch is a one-piece unit having an outside diameter and an inside diameter and a height, where the inside diameter is sized to create a frictional interface with the dart, and wherein the clutch further includes a gap extending from the outside diameter to the inside diameter along the height of the clutch.

60. The dart plunger of claim 51 wherein the clutch is a one-piece unit having an outside diameter and an inside diameter, where the inside diameter is sized to create a frictional interface with the dart, and wherein the clutch includes a spiral cut in at least a portion of the outside diameter of the clutch.

* * * * *